US006743057B2

(12) United States Patent
Davis et al.

(10) Patent No.: US 6,743,057 B2
(45) Date of Patent: Jun. 1, 2004

(54) ELECTRICAL CONNECTOR TIE BAR

(75) Inventors: Wayne Samuel Davis, Harrisburg, PA (US); Robert Neil Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 17 days.

(21) Appl. No.: 10/107,858

(22) Filed: Mar. 27, 2002

(65) Prior Publication Data

US 2003/0186594 A1 Oct. 2, 2003

(51) Int. Cl.[7] ..... H01R 13/684
(52) U.S. Cl. ..... 439/701; 439/608
(58) Field of Search ..... 439/608, 701, 439/719

(56) References Cited

U.S. PATENT DOCUMENTS

| | | | | |
|---|---|---|---|---|
| 4,857,017 A | | 8/1989 | Erk | 439/695 |
| 5,213,515 A | | 5/1993 | Ishikawa et al. | 439/79 |
| 5,688,129 A | | 11/1997 | Flaherty | 439/79 |
| 5,692,912 A | | 12/1997 | Nelson et al. | 439/79 |
| 5,993,259 A | | 11/1999 | Stokoe et al. | 439/608 |
| 6,146,202 A | * | 11/2000 | Ramey et al. | 439/608 |
| 6,196,853 B1 | * | 3/2001 | Harting et al. | 439/79 |
| 6,347,962 B1 | | 2/2002 | Kline | 439/608 |
| 6,514,103 B2 | * | 2/2003 | Pape et al. | 439/608 |
| 2001/0049229 A1 | | 12/2001 | Pape et al. | 439/608 |
| 2002/0013101 A1 | | 1/2002 | Long | 439/625 |

OTHER PUBLICATIONS

International Search Report, Applicant's or agent's file reference 17771 PCT, International filing dated Mar. 25, 2003, International application No. PCT/US 03/09117.

* cited by examiner

*Primary Examiner*—Renee Luebke
*Assistant Examiner*—Ann McCamey

(57) ABSTRACT

An electrical connector with a plurality of signal modules stacked therein is provided. Ground shields are interleaved between adjacent signal modules. The signal modules include signal traces that may, or may not, be arranged in differential pairs and mating faces configured to join a mating connector and a PCB. The signal modules include a notch formed in at least one edge. The notches align with one another to form a channel that receives a cross-link that reduces relative movement between signal modules. The cross-link may be a flat bar having a series of cutouts that are slidably received by the signal modules. The electrical connector may include one or more cross-links. Optionally, the cross-link may be made of a conductive material and engage the ground shields, thereby electrically interconnecting the ground shields.

17 Claims, 9 Drawing Sheets

ELECTRICAL CONNECTOR TIE BAR

BACKGROUND OF THE INVENTION

Certain embodiments of the present invention generally relate to an electrical connector assembly having a receptacle connector mateable with a header connector, and more particularly, to apparatus for stabilizing and securing signal modules within an electrical connector assembly.

It is common, in the electronics industry, to use right angled connectors for electrical connection between two printed circuit boards or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact there between. Because of industry demand for high frequency of signal transmission in a relatively small envelope, electrical connectors typically include several signal pathways in relatively small space. The signal pathways may or may not be grouped into several signal modules. Signal modules are typically thin and stacked side by side into electrical connectors.

U.S. Pat. No. 4,857,017 teaches a right angle electrical connector including a series of contact pins configured to be engaged with a printed circuit board (PCB) or a mating connector. The right angle electrical connector is designed to receive a support member. The support member has a comb-like structure that contains grooves for receiving portions of the pins. The grooves of the support member secure the pins in place to prevent the pins from moving during engagement with a PCB or mating connector. Movement of the pins during engagement with a PCB or mating connector can cause misalignment with vias on a PCB or sockets on a mating connector causing damage to the pins.

U.S. Pat. No. 5,213,515 teaches a surface mount electrical connector that includes closely packed contact configured to mate with a PCB. The surface mount electrical connector is designed to receive a support member. The support member has a comb-like structure that includes grooves for receiving portions of the pins. The grooves of the support member secure the pins in place during mating with a PCB. The support member facilitates the soldering of the closely packed pins to closely packed traces on the PCB and allows a better inspection of the resulting solder connections.

U.S. Pat. No. 5,692,912 teaches an electrical connector coupled with a tail-aligning device. The tail aligning-device has a matrix of holes for receiving pins or tail portions of contacts that are housed in the electrical connector. When the tail-aligning device is coupled to the electrical connector, the holes retain the pins in the proper alignment.

U.S. Pat. No. 5,688,129 teaches an electrical connector coupled with a lead positioning comb. The lead positioning comb has grooves for receiving pins or terminal leads of contacts that are housed in the electrical connector. The electrical connector is configured to be mounted onto a PCB, and the pins are configured to penetrate corresponding vias in a PCB. When the lead positioning comb is engaged with the electrical connector, the grooves hold the pins in the proper alignment for mounting onto a PCB.

However, a disadvantage of the above mentioned devices for properly aligning pins extending from electrical connectors is that the devices require a groove and/or hole for each pin. Because of industry demand for higher frequency signal transmission in smaller envelopes, electrical connectors typically include a great number of precisely arranged and closely packed pins. Accordingly, the devices require a correspondingly large number of precisely arranged and closely packed grooves and/or holes for receiving the pins. As electrical connectors employ increasingly larger numbers of closely packed pins, the devices must similarly employ increasingly larger numbers of grooves and/or holes. Increasing the number of grooves and/or holes increases the complexity of the devices, which, in turn, increases manufacturing costs.

A need remains for an improved device for stabilizing pins of an electrical connector.

BRIEF SUMMARY OF THE INVENTION

An embodiment of the present invention provides an electrical connector with a plurality of signal modules stacked therein. Ground shields are interleaved between adjacent signal modules. The signal modules include signal traces arranged in differential pairs and mating faces configured to join a mating connector and a PCB. Optionally, the signal traces need not be arranged in differential pairs. The signal modules include a notch formed in at least one edge. The notches align with one another to form a channel that receives a cross-link that reduces relative movement between signal modules. The cross-link may be positioned on the rear edges of the signal modules, or optionally, the cross-link may be positioned elsewhere on the signal modules. The electrical connector may include one or more cross-links.

The cross-link may be a flat bar having a series of cutouts that are slidably received by the signal modules. Optionally, the cross-link may include reinforcement spacers or spacer projections that separate the cutouts from one another and that are inserted between and against the signal modules. Optionally, the cross-link may include facing ribs on opposite sides of the cutouts and/or extending from opposite sides, of the spacer projections for frictionally engaging the signal modules.

Optionally, the ground shields may include edges having notches formed therein that align with the notches in the signal modules to form a channel that receives the cross-link. The cross-link may be made of a conductive material and engage the ground shields, thereby electrically interconnecting the ground shields.

Figure 1:
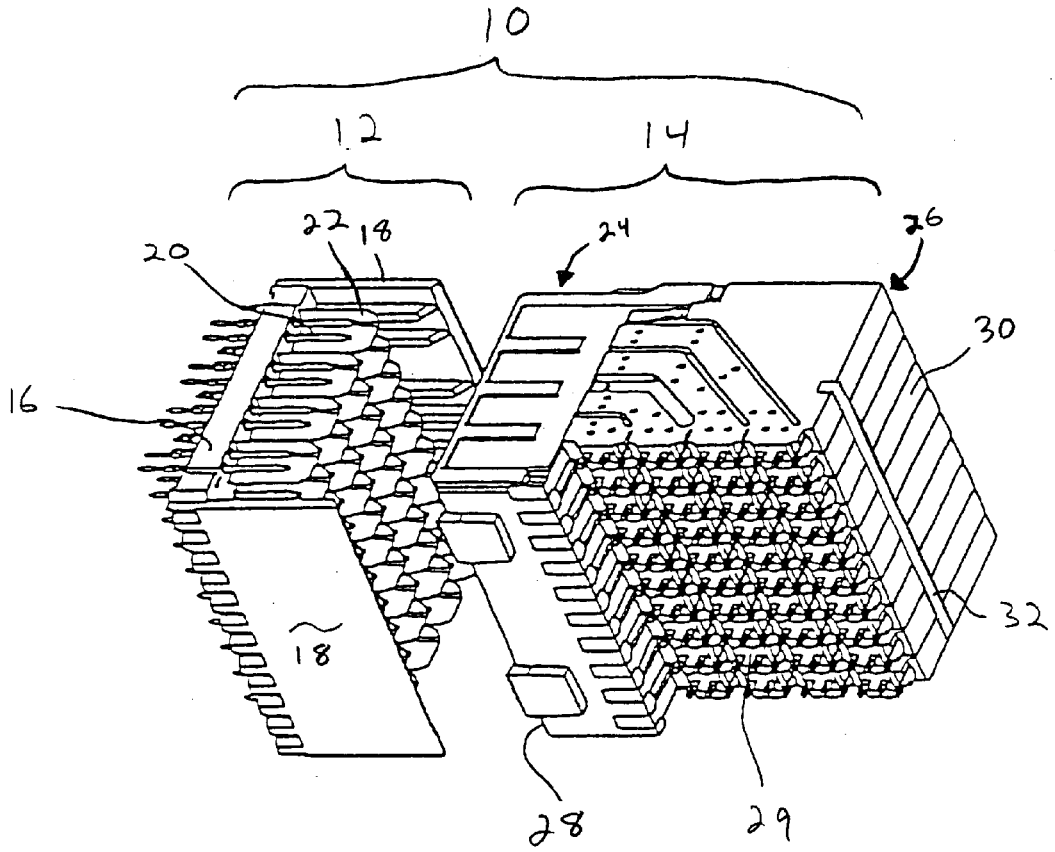
FIG. 1 illustrates a bottom front perspective view of a connector assembly, having a header assembly and a receptacle assembly unmated formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a connector assembly 10 including a header assembly 12 and a receptacle assembly 14. The header assembly 12 includes a base 16 and sidewalls 18. The base 16 retains an array or matrix of header contacts 20 and header contact ground shields 22. The receptacle assembly 14 includes an insulated housing 24 having multiple signal modules 26 mounted therein. The receptacle assembly 14 includes a header-mating face 28 having a plurality of openings therein aligned with the header contacts 20 and header contact ground shields 22. The header contact ground shields 22 and header contacts 20 are joined with receptacle grounds 25 (FIG. 7) and receptacle contacts 27 (FIG. 7), respectively, contained in the signal modules 26. The receptacle assembly 14 includes a PCB-mating face 29, arranged perpendicular to the header-mating face 28, for mating with a PCB (not shown). The signal modules 26 include back edges 30 opposite the header-mating face 28. The back edges 30 are interlinked by a tie bar 32.

Figure 2:
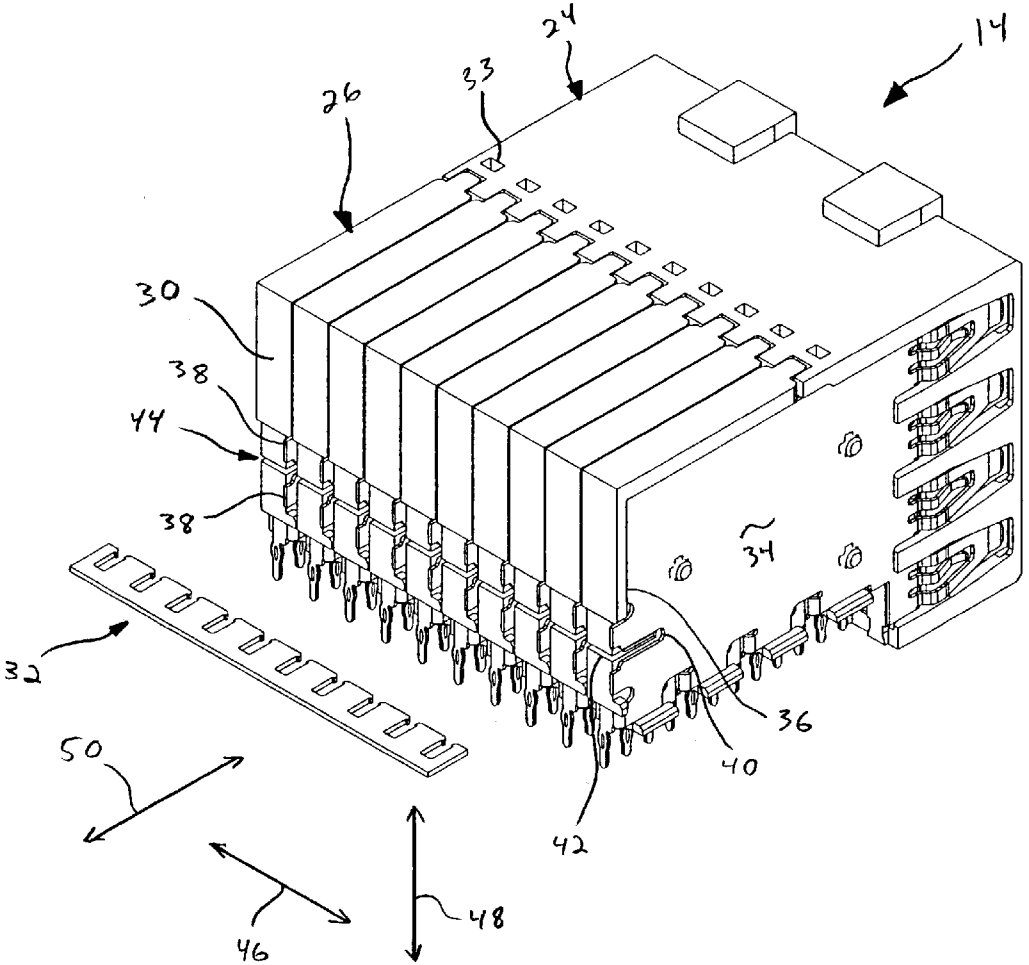
FIG. 2 illustrates a top front perspective view of a receptacle assembly and a tie bar formed in accordance with an embodiment of the present invention.

FIG. 2 illustrates a detailed view of the receptacle assembly 14 of FIG. 1. The insulated housing 24 includes windows 33 for securing the signal modules 26 to the insulated housing 24. Each signal module 26 includes a ground shield 34 mounted to its side so that one ground shield 34 is positioned between adjacent signal modules 26. The ground shields 34 include back edges 36 having tabs 38 extending therefrom. The tabs 38 are spaced apart from one another to form slots 40 therebetween. The back edges 30 of the signal modules 26 include notches 42 that align with one another and with the slots 40 to form a channel 44. The signal modules 26 are aligned in parallel planes. The channel 44 extends along an axis substantially transverse to the planes containing the signal modules 26. The channel 44 extends along the back edges 30 of the signal modules 26. The channel 44 receives the tie bar 32 for stabilizing the receptacle assembly 14 and retaining the signal modules 26 in place relative to one another. The tie bar 32 resists movement of the signal modules 26 relative to one another in the lateral direction indicated by arrow 46, in the vertical direction indicated by arrow 48, and in the longitudinal direction indicated by arrow 50. The vertical and longitudinal directions 48 and 50 extend parallel to planes containing the signal modules 26, while the lateral direction 46 extends transverse to the planes of the signal modules 26.

Figure 3:
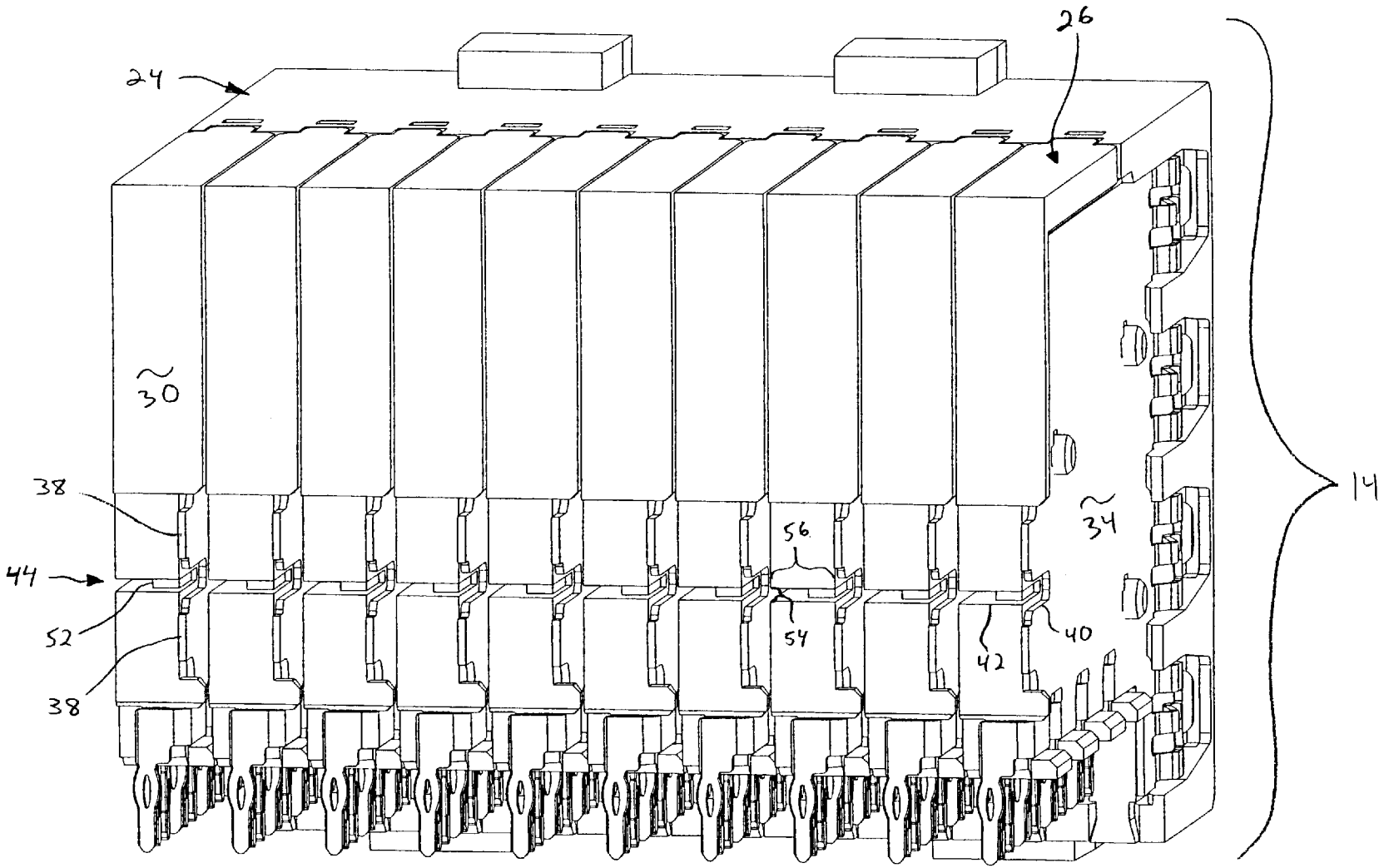
FIG. 3 illustrates a detailed top front perspective view of the receptacle assembly of FIG. 2.

FIG. 3 illustrates an even greater detailed view of the receptacle assembly 14. The signal modules 26 include rails 52 sandwiched within the notches 42 in the back edges 30. The notches 42 include a height 54 and width 56. The rails 52 extend vertically the entire height 54 of the notches 42, but the rails 52 do not extend the entire width 56 of the notches 42. The rails 52 are intermittently dispersed within the channel 44 for receiving cutouts 58 (FIG. 4) on the tie bar 32.

Figure 4:
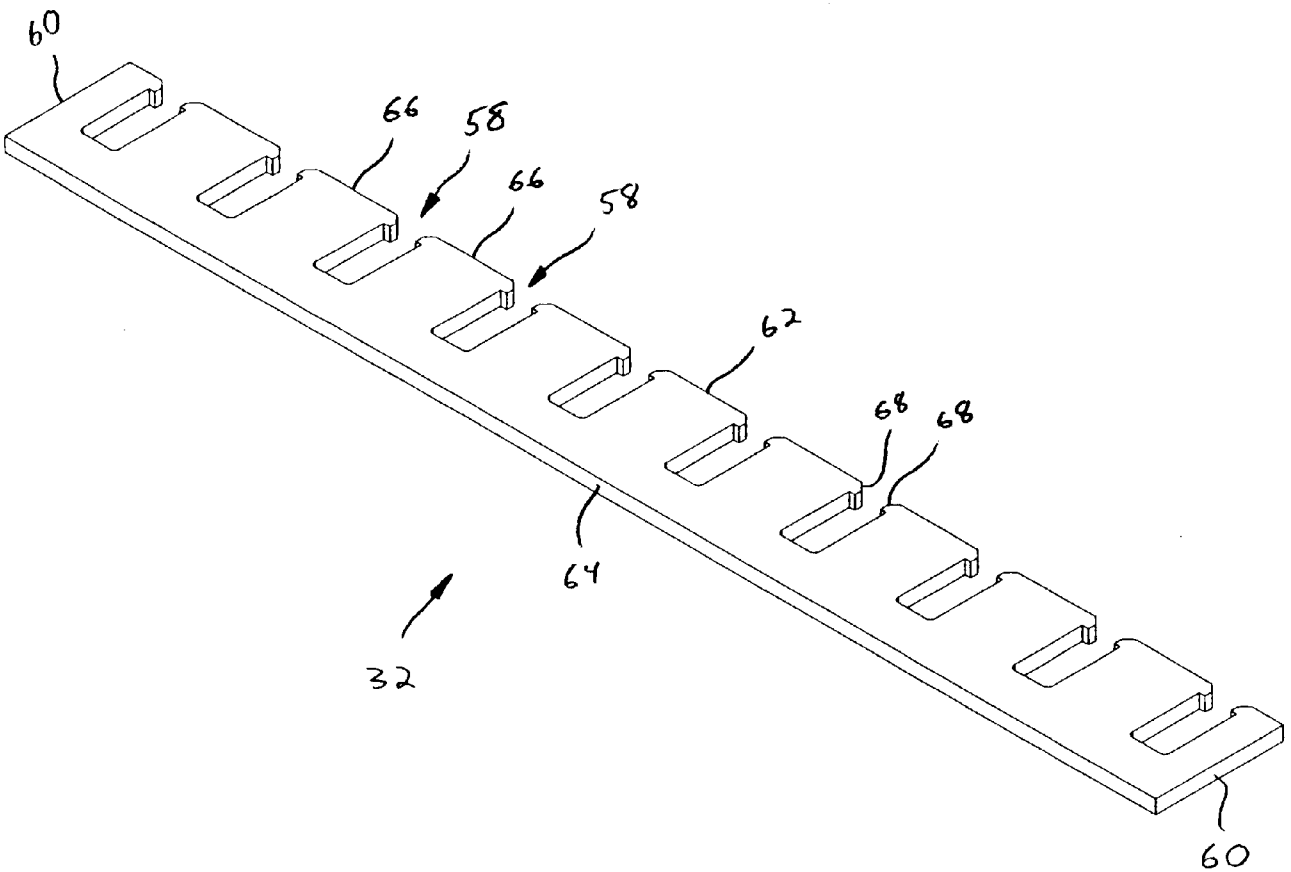
FIG. 4 illustrates a detailed top front perspective view of a tie bar formed in accordance with an embodiment of the present invention.

FIG. 4 illustrates the tie bar 32. The tie bar 32 is flat and of a generally rectangular shape. The tie bar 32 includes ends 60 and front and back edges 62 and 64. The front edge 62 includes a series of parallel rectangular cutouts 58 formed therein for receiving the rails 52 (FIG. 3) when the tie bar 32 is inserted into the notches 42 in the back edges 30 of the signal modules 26. The cutouts 58 are separated from one another by teeth 66. The teeth 66 include ribs 68 positioned proximate the front edge 62 and facing one another to partially extend into the cutouts 58. The ribs 68 frictionally engage the rails 52 when the channel 44 receives the tie bar 32.

Figure 5:
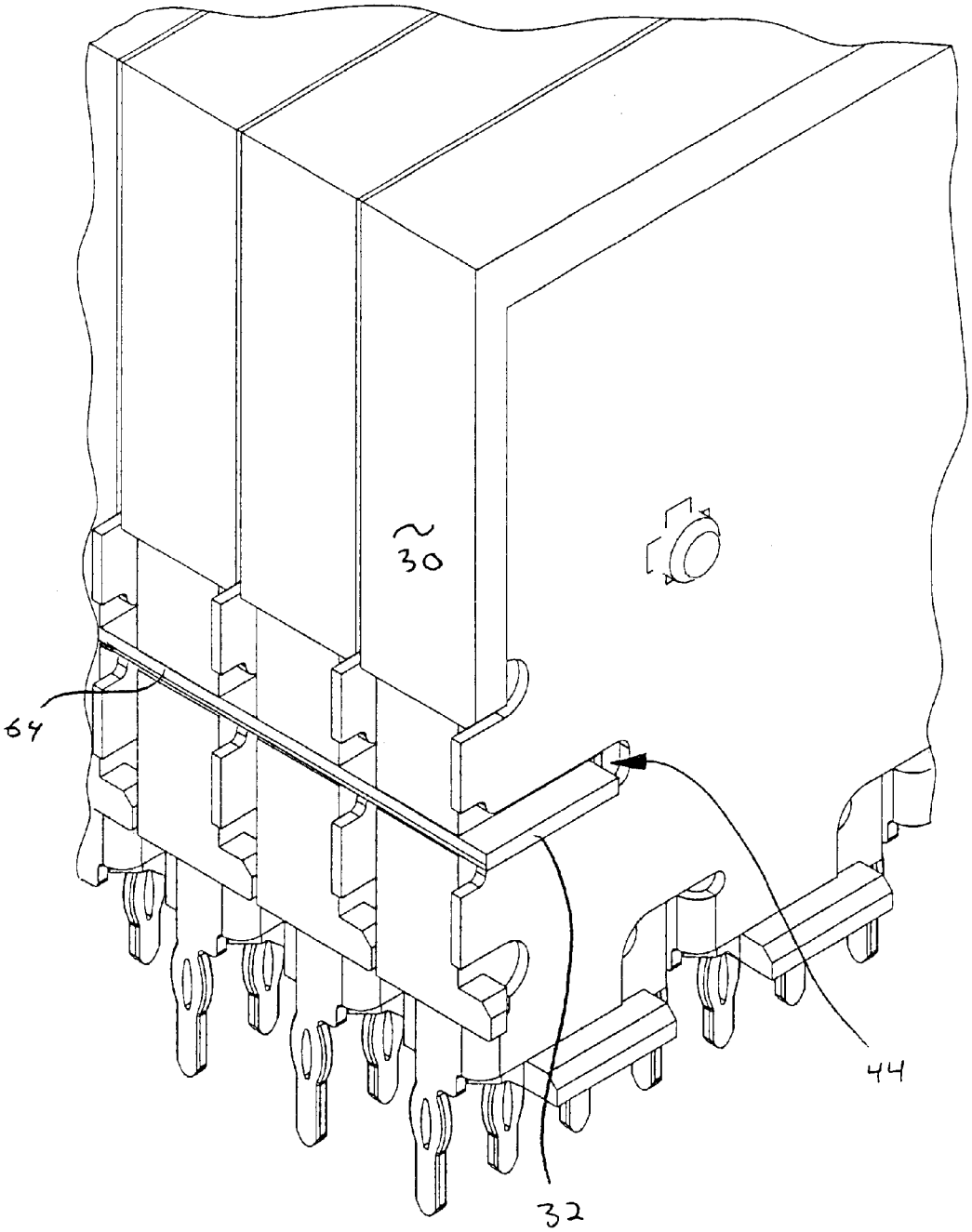
FIG. 5 illustrates a detailed isometric view of a portion of the receptacle assembly of FIG. 2 with the tie bar inserted.

FIG. 5 illustrates a detailed view of a portion of the receptacle assembly 14 with the tie bar 32 inserted into the channel 44. The tie bar 32 is inserted until the back edge 64 is flush with the back edges 30 of the signal modules 26.

Figure 6:
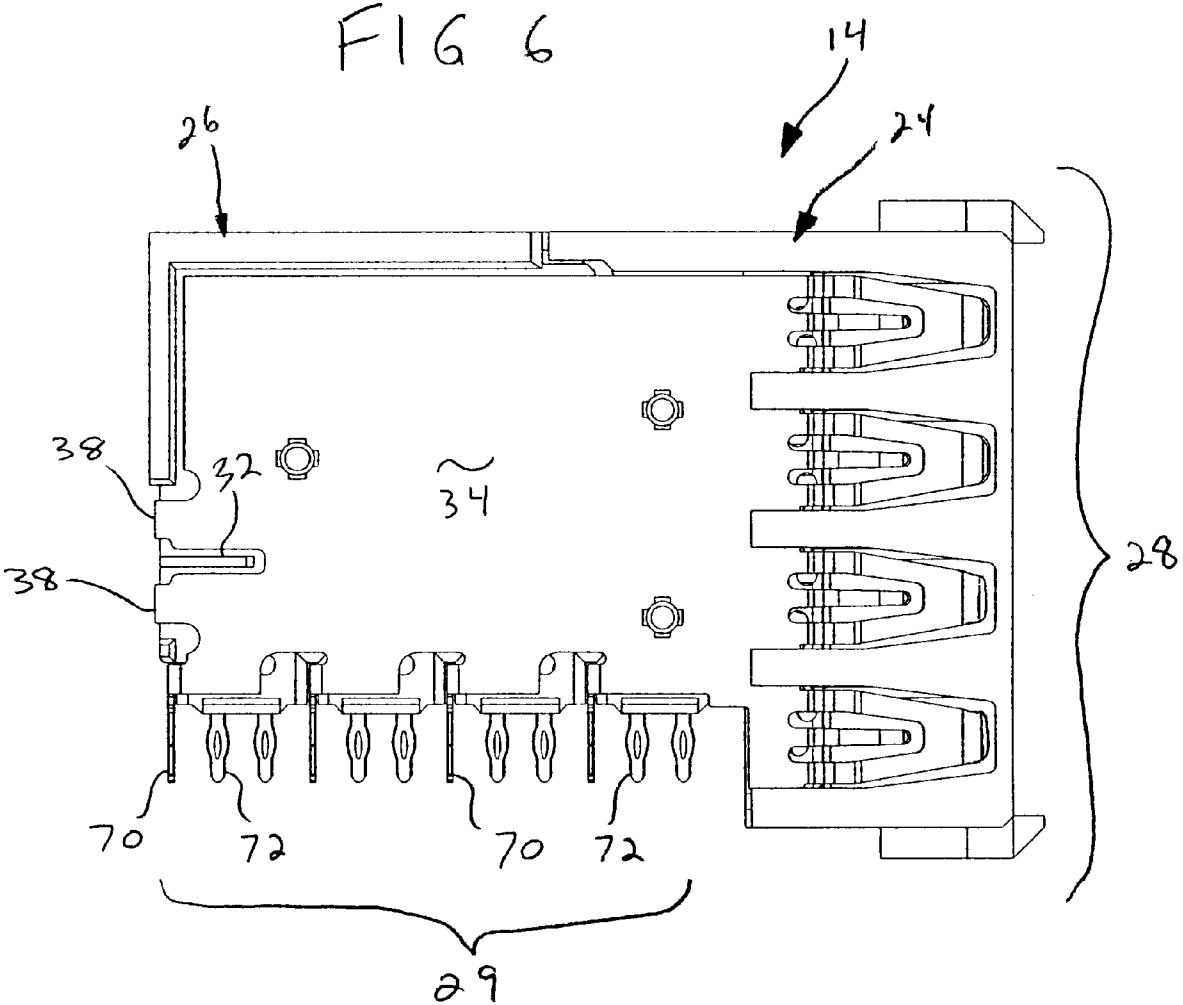
FIG. 6 illustrates a side plan view of the receptacle assembly of FIG. 2 with the tie bar inserted.

FIG. 6 illustrates a side view of the receptacle assembly 14. The ground shields 34 and signal modules 26 include ground pins 70 and signal pins 72, respectively, positioned along the PCB-mating face 29. The ground pins 70 have planes that are arranged perpendicular to the ground shields 34 and the signal modules 26. The signal pins 72 have planes that are arranged parallel to the ground shields 34 and the signal modules 26. Thus, the planes of the ground pins 70 and the planes of the signal pins 72 are perpendicular to one another. By way of example only, each ground shield 34 includes four ground pins 70, and each signal module 26 includes eight signal pins 72.

Figure 7:
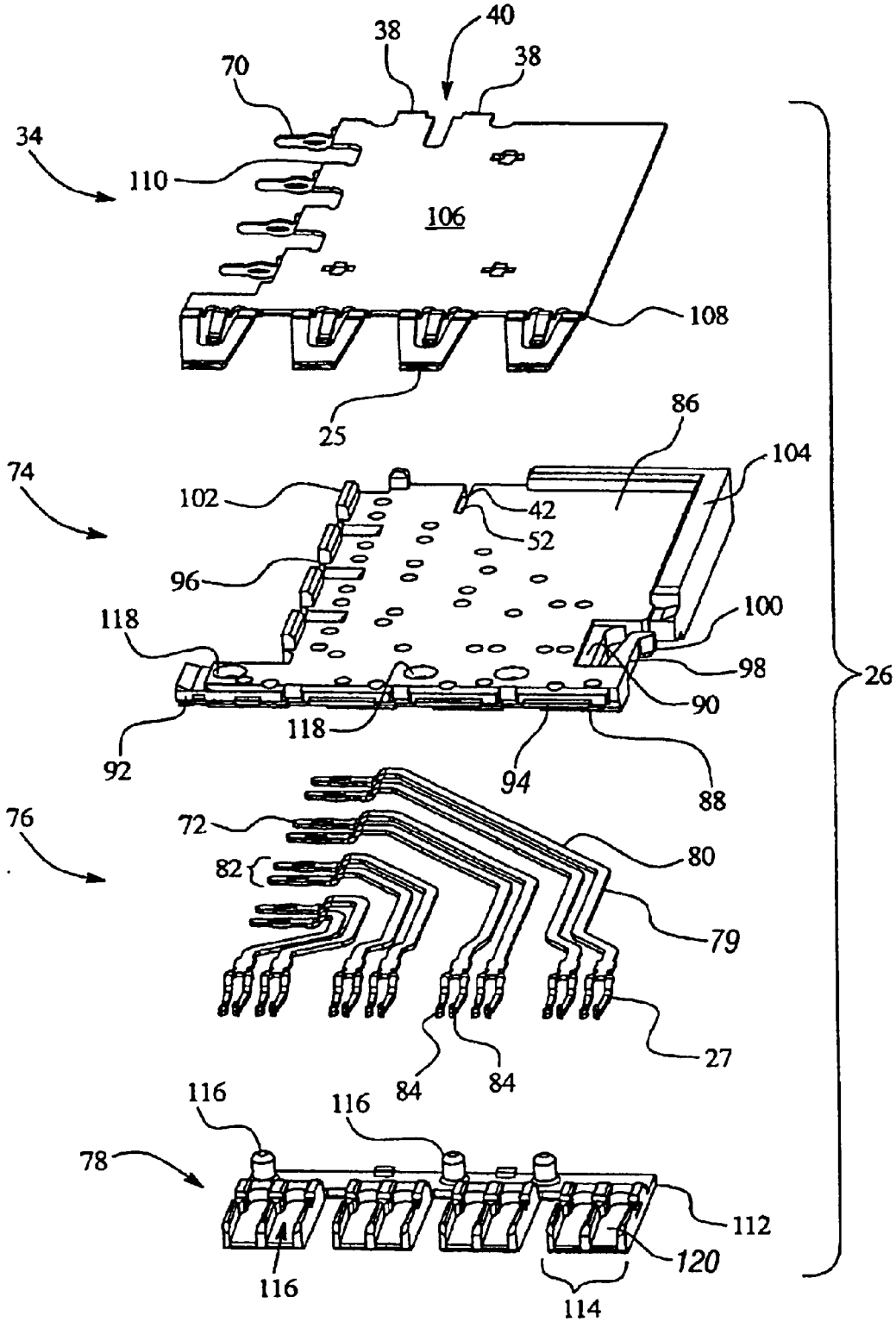
FIG. 7 illustrates an exploded view of a signal module formed in accordance with an embodiment of the present invention.

FIG. 7 illustrates the signal module 26 of FIG. 1 separated into its component parts. The signal module 26 includes the ground shield 34 that is mounted to a plastic over molded portion 74. The over molded portion 74 retains a lead frame 76. A cover 78 is mounted to one end of the over molded portion 74 to protect the receptacle contacts 27 that are located along one end of the lead frame 76. The lead frame 76 is comprised of a plurality of leads 79, each of which includes a signal pin 72 and a receptacle contact 27. Each signal pin 72 and corresponding receptacle contact 27 is connected through an intermediate conductive trace 80. By way of example only, the leads 79 may be arranged in lead differential pairs 82. In the example of FIG. 7, four lead differential pairs 82 are provided in each signal module 26. By way of example only, the receptacle contacts 27 may be formed in a "tuning fork" shape with opposed fingers 84 biased toward one another. The fingers 84 frictionally and conductively engage a corresponding header contact 20 on the header assembly 14 (FIG. 1) when the receptacle assembly 14 and header assembly 12 are fully mated. The signal pins 72 may be inserted into corresponding vias in a PCB (not shown) and connected with associated electrical traces.

The over molded portion 74 includes top and bottom insulated layers 86 and 88 that are spaced apart from one another to define a space 90 therebetween in which the lead frame 76 is inserted. The over molded portion 74 includes a front edge 92 having a plurality of openings 94 therein through which the receptacle contacts 27 project. The over molded portion 74 also includes a bottom edge 96 having a similar plurality of openings (not shown) through which the signal pins 72 extend. A latch arm 98 is provided along the top of the over molded portion 74. The latch arm 98 includes a raised ledge 100 on the outer end thereof to snappily engage a corresponding window 33 on the insulated housing 24 of the receptacle assembly 14.

The over molded portion 74 includes a series of projections 102 extending upward from the bottom edge 96 and an L-shaped bracket 104 extending upward from rear and top edges. The projections 102 and bracket 104 cooperate to define a region in which the ground shield 34 is received. The ground shield 34 is mounted against the top layer 86 of the over molded portion 74. The ground shield 34 includes a main body 106, with a front mating edge 108 and a bottom mating edge 110. The ground pins 70 extend from the bottom mating edge 110 and are configured to conductably connect the ground shield 34 to grounds on a PCB. The front mating edge 108 includes a plurality of ground contacts 25 that conductably connect the ground shield 34 to the header contact ground shields 22 when the header assembly 12 and receptacle assembly 14 are mated.

The cover 78 includes a base shelf 112 and multiple differential shells 114 formed therewith. Mounting posts 116 on the cover 78 are received within holes 118 through the top and bottom layers 86 and 88. The mounting posts 116 may be secured to the holes 118 in a variety of manners, such as through a frictional fit, with adhesive and the like. Each differential shell 114 includes channels 120 that receive the receptacle contacts 27.

Figure 8:
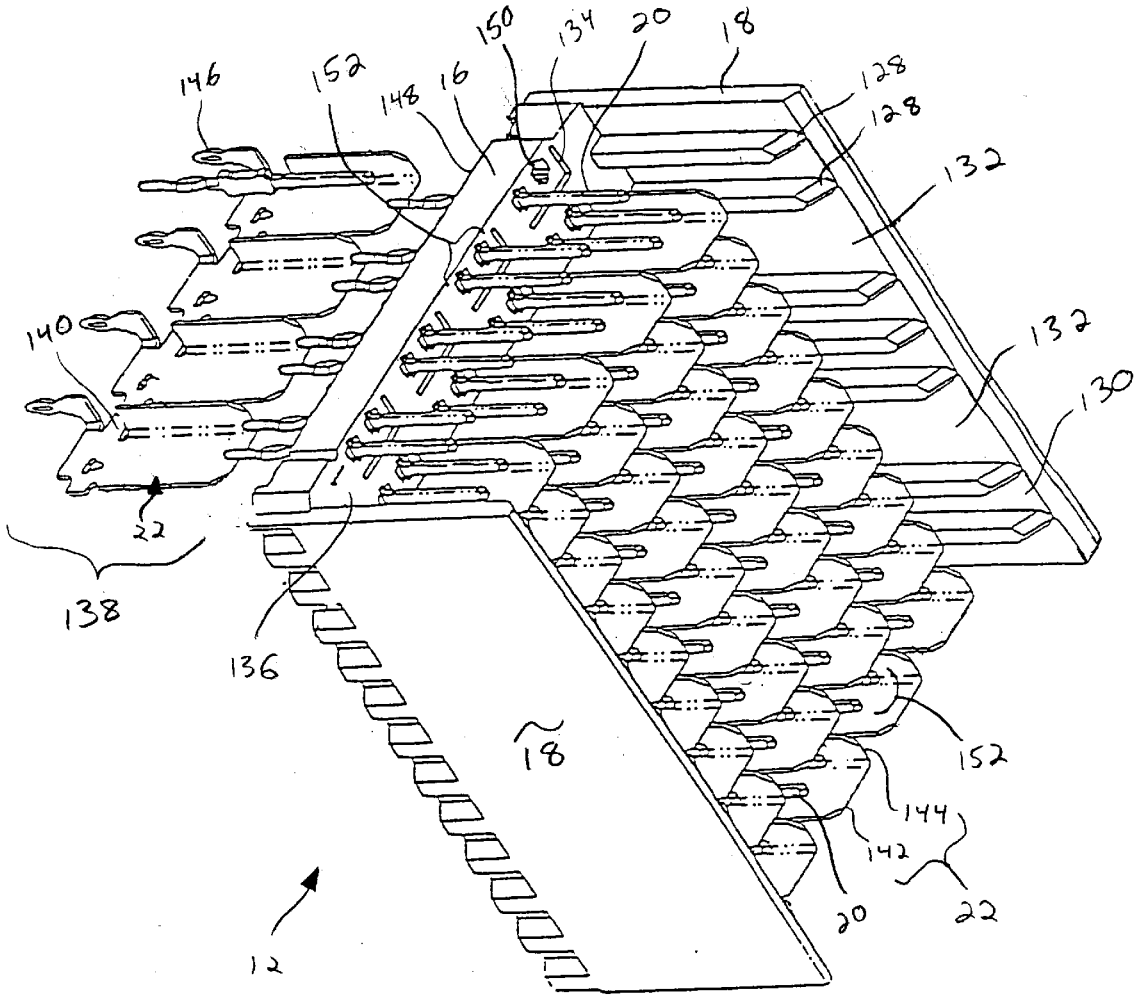
FIG. 8 illustrates a top front perspective view of the header assembly of FIG. 1 partially exploded.

FIG. 8 illustrates the header assembly 12 in more detail. The sidewalls 18 include a plurality of ribs 128 formed on the interior surfaces thereof. Gaps 130 are formed between the ribs 128 as part of a void core manufacturing process. Void coring may be used to avoid the formation of sinkholes in the sidewalls 18. Groups of ribs 128 may be separated by large gaps to form guide channels 132 that are used to guide the header assembly 12 and the receptacle assembly 14 onto one another. The guide channels 132 may also be formed with different widths in order to operate as a polarizing feature to ensure that the receptacle assembly 14 is properly oriented before mating with the header assembly 12.

The base 16 of the header assembly 12 includes a plurality of L-shaped notches 134 cut therethrough. The L-shaped notches 134 are aligned in rows and columns to define a matrix across a receptacle-mating face 136 of the header assembly 12. The receptacle-mating face 136 abuts against the header-mating face 28 on the receptacle assembly 14 when the connector assembly 10 is fully joined. The header assembly 12 receives a plurality of ground shield segments 138, each of which includes four header contact ground shields 22 (in the example of FIG. 8). A ground shield segment 138 may be stamped from a single sheet of metal. Jumper straps 140 join the four header contact ground shields 22. Each header contact ground shield 22 includes a blade portion 142 and a leg portion 144 bent to form an L-shape. Ground pins 146 are stamped from the same piece of metal as the remainder of the ground shield segment 138 and are integral with the four header contact ground shields 22. While not illustrated in FIG. 8, slots are provided along a rear surface 148 of the base 16 between notches 134 to receive the jumper straps 140 until flush with the rear surface 148. The slots between the notches 134 do not extend fully through the base 16 to the receptacle-mating face 136.

The base 16 also includes a plurality of header contact holes 150 cut therethrough. The header contact holes 150, in the example of FIG. 8, are arranged in pairs 152 in order to receive corresponding pairs of header contacts 22. Each pair 152 of holes 150 is located in the interior of a corresponding L-shaped notch 134 such that the associated pair of header contacts 20 is shielded on two sides by the blade portion 142 and leg portion 144 of the corresponding contact ground shields 22.

Figure 9:
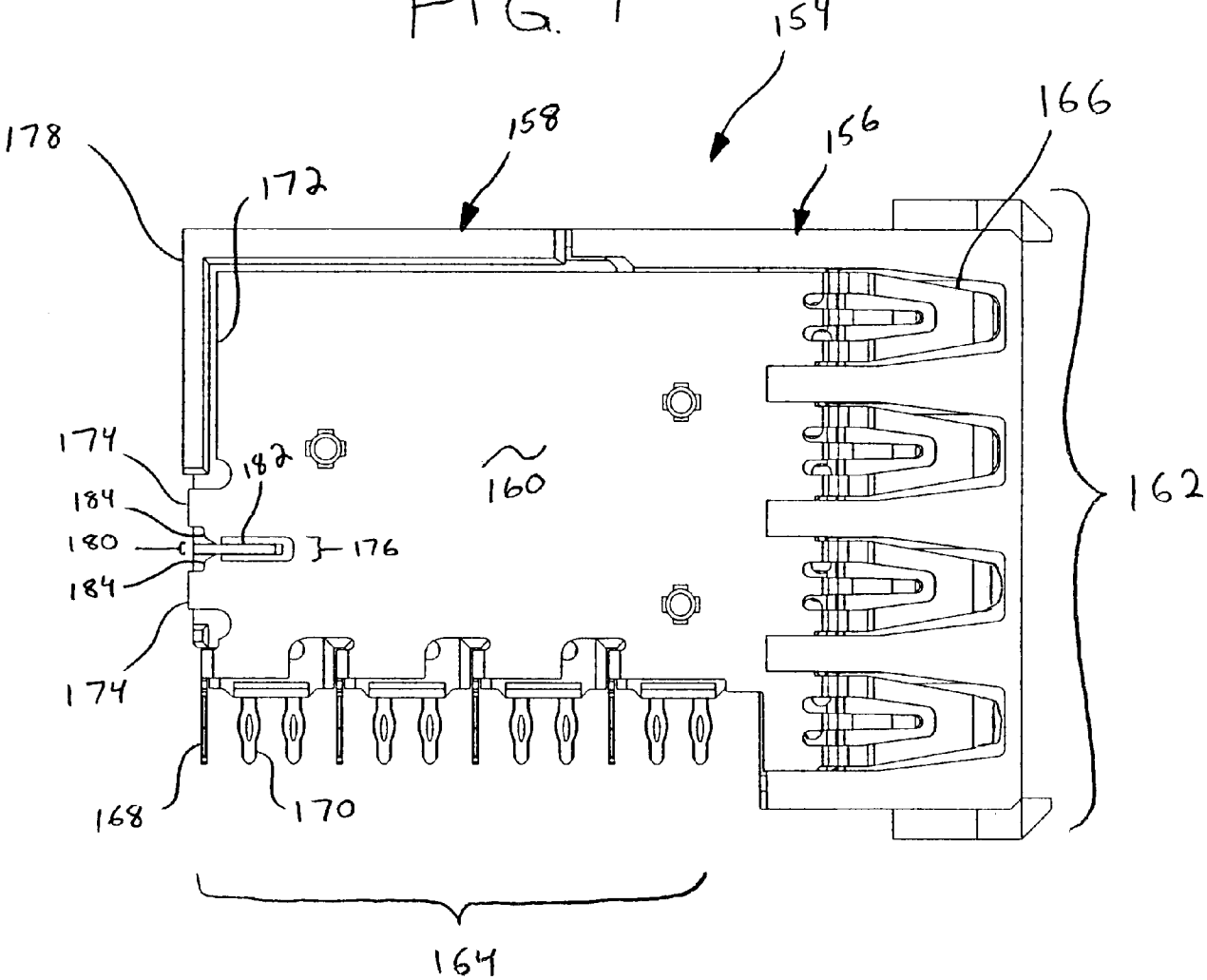
FIG. 9 illustrates a side plan view of a receptacle assembly formed in accordance with an alternative embodiment of the present invention.

FIG. 9 illustrates a side view of a receptacle assembly 154 formed in accordance with an alternative embodiment of the present invention. The receptacle assembly 154 includes an insulated housing 156 having a plurality of signal modules 158 stacked side by side therein. In the illustration of FIG. 9, however, only one signal module 158 can be seen. Each signal module 158 includes a ground shield 160 mounted to its side so that the ground shields 160 are positioned between adjacent signal modules 158. The receptacle assembly 154 includes a header-mating end 162 configured to mate with the header assembly 12 and a PCB-mating end 164 configured to mate with a PCB (not shown). The header-mating end 162 and the PCB-mating end 164 are arranged in planes that are perpendicular to one another. The ground shields 160 and signal modules 158 include receptacle grounds 166 and receptacle contacts (not visible), respectively, along the header-mating end 162. The ground shields 160 and signal modules 158 include ground pins 168 and signal pins 170, respectively, along the PCB-mating end 164.

The ground pins 168 have planes that are arranged perpendicular to the ground shields 160 and the signal modules 158. The signal pins 170 have planes that are arranged parallel to the ground shields 160 and signal modules 158. Thus, the planes of the ground pins 168 and the planes of the signal pins 170 are perpendicular to one another. By way of example only, each ground shield 160 includes four ground pins 168, and each signal module 158 includes eight signal pins 170.

The ground shields 160 include back edges 172 having tabs 174 extending rearward therefrom. The tabs 174 are spaced apart to form slots 176. The signal modules 158 include back edges 178 having notches 180 that align with one another and with the slots 176 in order to receive a tie bar 182. The tie bar 182 stabilizes the receptacle assembly 154 and retains the signal modules 158 in place laterally relative to one another.

The tabs 174 include facing ribs 184 that protrude toward one another into the slots 176 and electrically engage the tie bar 182, which is composed of a conductive material. Thus, in addition to stabilizing the receptacle assembly 154 and retaining the signal modules 158 in place relative to one another, the tie bar 182 electrically interconnects all of the ground shields 160 to improve the shielding characteristics of the receptacle assembly 154.

While certain embodiments of the present invention employ the receptacle assembly having only one tie bar, the number of tie bars is in no way limited to one.

While certain embodiments of the present invention employ the receptacle assembly having the tie bar positioned on the rear of the receptacle assembly, other embodiments may include tie bars positioned at other locations, such as along the top, through the middle of the signal modules and the like.

While certain embodiments of the present invention employ the tie bar inserted into a receptacle assembly, other embodiments may employ tie bars inserted into other electrical connector assemblies, such as header assemblies.

While certain embodiments of the present invention employ the tie bar inserted into a right angle connector assembly, other embodiments may employ tie bars inserted into straight connector assemblies.

While certain embodiments of the present invention employ signal modules for carrying data signals, the term signal module is not limited to modules that carry data signals. Instead, the term signal module also includes modules that carry power.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. An electrical connector comprising:

a housing;

signal modules held in said housing, said signal modules including first and second mating faces configured to join a mating connector and a printed circuit board, respectively, said signal modules carrying signal traces configured in differential pairs, said signal modules each including a notch formed in a rear edge thereof which is located opposite said first mating face, wherein said notches in adjacent signal modules align to form a channel;

ground shields interleaved between said signal modules; and a cross-link slidably inserted into said channel along said at least one edge of said signal modules to reduce relative movement between said signal modules.

2. The electrical connector of claim 1, wherein each of said ground shields includes an edge, said edge having a notch formed therein.

3. The electrical connector of claim 1, wherein said cross-link is a flat bar having a series of cutouts formed along one edge thereof, said cutouts being slidably received over said at least one edge of said signal modules within said channel.

4. The electrical connector of claim 1, wherein said cross-link includes multiple cross-links.

5. The electrical connector of claim 1, wherein said cross-link includes a series of cutouts separated by reinforcement spacers, said reinforcement spacers being inserted between, and abutting against, said signal modules when said cross-link is inserted in said housing.

6. The electrical connector of claim 1, wherein said cross-link includes cutouts, at opening of said cutouts, facing ribs on opposite sides of said cutouts frictionally engaging opposite sides of corresponding signal modules when said cross-link is inserted in said housing.

7. The electrical connector of claim 1, wherein said cross-link includes a series of spacer projections inserted between adjacent signal modules, said spacer projections firmly abutting against facing sides of said adjacent signal modules to resist relative motion between said adjacent signal modules when said cross-link is inserted in said housing.

8. The electrical connector of claim 1, wherein said cross-link includes a series of spacer projections, each of said spacer projections having ribs formed on opposite sides thereof, said ribs engaging sides of corresponding signal modules when said cross-link is inserted in said housing.

9. An electrical connector comprising:

a housing;

signal modules held in said housing, said signal modules including first and second mating faces configured to join a mating connector and a printed circuit board, respectively, said signal modules including signal traces extending between said first and second mating faces, said signal modules each including a notch formed in a rear edge thereof located opposite said first mating face, wherein said notches in adjacent signal modules align to form a channel;

ground shields interleaved between said signal modules; and a cross-link slidably inserted into said channel along said at least one edge of said signal modules to reduce relative movement between said signal modules.

10. The electrical connector of claim 9, wherein said signal traces are configured in differential pairs.

11. The electrical connector of claim 9, wherein each of said ground shields includes an edge, said edge having a notch formed therein.

12. The electrical connector of claim 9, wherein said cross-link is a flat bar having a series of cutouts formed along one edge thereof, said cutouts slidably received over said at least one edge of said signal modules within said channel.

13. The electrical connector of claim 9, wherein said cross-link includes multiple cross-links.

14. The electrical connector of claim 9, wherein said cross-link includes a series of cutouts separated by reinforcement spacers, said reinforcement spacers being inserted between, and abutting against, said signal modules when said cross-link is inserted in said housing.

15. The electrical connector of claim 9, wherein said cross-link includes cutouts, at opening of said cutouts, facing ribs on opposite sides of said cutouts frictionally engaging opposite sides of a corresponding signal modules when said cross-link is inserted in said housing.

16. The electrical connector of claim 9, wherein said cross-link includes a series of spacer projections inserted between adjacent signal modules, said spacer projections firmly abutting against facing sides of said adjacent signal modules to resist relative motion between said adjacent signal modules when said cross-link is inserted in said housing.

17. The electrical connector of claim 9, wherein said cross-link includes a series of spacer projections, each of said spacer projections having ribs formed on opposite sides thereof, said ribs engaging sides of corresponding signal modules when said cross-link is inserted in said housing.

* * * * *